United States Patent [19]

Heath

[11] 4,072,443

[45] Feb. 7, 1978

[54] CONTROL VALVE ARRANGEMENTS FOR VARIABLE STROKE PUMPS

[75] Inventor: Ronald Alfred Heath, Birmingham, England

[73] Assignee: Lucas Industries Limited, Birmingham, England

[21] Appl. No.: 725,435

[22] Filed: Sept. 22, 1976

[30] Foreign Application Priority Data

Oct. 4, 1975 United Kingdom ..... 40705/75

[51] Int. Cl.[2] ..... F04B 49/08

[52] U.S. Cl. ..... 417/218; 60/452

[58] Field of Search ..... 417/213, 218, 221, 222; 60/445, 452

[56] References Cited

U.S. PATENT DOCUMENTS

| | | | |
|---|---|---|---|
| 3,067,693 | 12/1962 | Lambeck | 417/219 |
| 3,732,041 | 5/1973 | Beal et al. | 417/222 |
| 3,768,928 | 10/1973 | Miller et al. | 417/222 X |
| 3,784,326 | 1/1974 | Lagana et al. | 417/221 |
| 3,784,327 | 1/1974 | Lonnemo | 417/222 |

FOREIGN PATENT DOCUMENTS

| | | | |
|---|---|---|---|
| 2,363,480 | 6/1975 | Germany | 417/221 |

OTHER PUBLICATIONS

Fluid Power Manual #1211 A, Delavan Manufacturing Company, 1969, p. 6, figure 2(right).

*Primary Examiner*—William L. Freeh
*Assistant Examiner*—Edward Look

[57] ABSTRACT

A control valve arrangement for regulating a servo pressure which in turn controls the stroke of a variable displacement pump has a control element positioned by means of an operating pressure derived from the pressure at the pump outlet. A solenoid valve is operable to reduce the operating pressure and thereby to position the control element so as to cause the pump stroke to be reduced. Movement of the control element beyond a predetermined position in a pump stroke reducing direction opens a bypass connection which maintains a small cooling flow through the pump.

5 Claims, 1 Drawing Figure

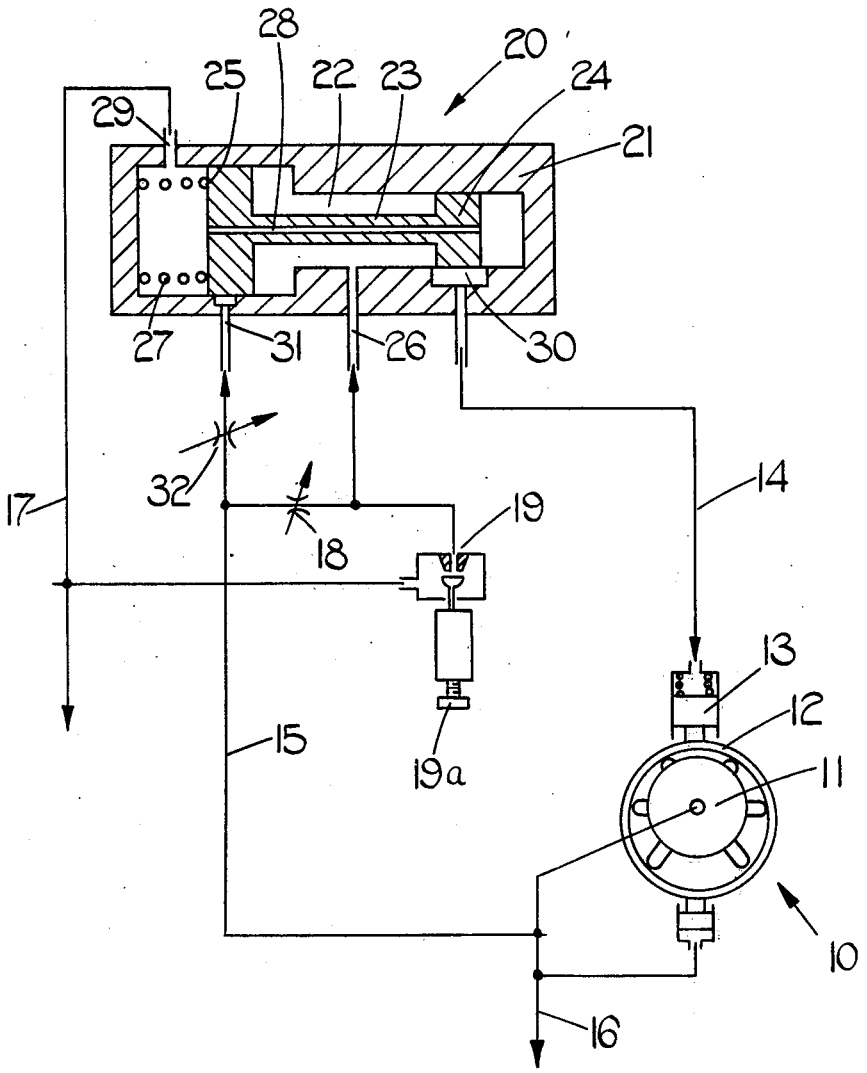
28
20
25
22
23
24
29
21
27
31
26
30
32
14
17
18
19
13
12
15
19a
11
10
16

CONTROL VALVE ARRANGEMENTS FOR VARIABLE STROKE PUMPS

This invention relates to control valve arrangements for variable stroke positive displacement pumps.

Hydraulic pumps for aircraft commonly spend the greater part of their operating time at stand-by, that is at zero flow demand or low flow demand conditions, and it is a usual practice to reduce the pump delivery pressure in the stand-by condition. It is common to use radial piston pumps for aircraft, since these pumps have a high power/weight ratio, and to run these pumps at high speeds to provide further weight saving for a given power output. High speed pumps tend to over heat unless they have a sufficient through flow of pumped fluid. Additionally the centrifugal forces present in radial piston pumps require that the pump shall maintain a sufficient output pressure to prevent breakdown of lubrication films. It is an object of the present invention to provide a control valve for a hydraulic pump, particularly for a radial piston pump, in which adequate flow and delivery pressures are automatically provided in the stand-by condition.

According to the invention there is provided a control valve arrangement for a variable-stroke positive displacement pump which includes a stroke-varying device operated by a servo pressure, said control valve arrangement comprising a body having a bore, a spool control element slidable in said bore, a first inlet communicating with said bore, means for applying to said first inlet an operating pressuring derived from the outlet pressure of said pump, said operating pressure urging said control element in a first direction, means biasing said control element against said operating pressure, a first outlet for connecting said bore to a low pressure, a second outlet communicating with said bore, said control element being operable to derive said servo pressure at said second outlet from the pressures at said first inlet and said first outlet, movement of said control element in said first direction acting to vary the servo pressure at said second outlet in a sense to reduce the stroke of said pump, and means for reducing the pressure at said first inlet.

In a preferred embodiment of the invention said means for reducing the pressure at the first inlet comprises a first restrictor which can communicate with the pump outlet and valve means for connecting the side of said first restrictor remote from the pump outlet to a low pressure, the interconnection between said first restrictor and said valve means communicating with said first inlet. A further preferred embodiment includes a second inlet opening into said bore and communicating with said means for applying said operating pressure to said first inlet, movement, beyond a predetermined point, of said spool control element by said biasing means, connecting said second inlet to a low pressure.

An embodiment of the invention will now be described by way of example only and with reference to the accompanying drawing.

A known type of radial piston pump 10 includes a rotor 11 and a cam ring 12 whose eccentricity with respect to the rotor 11 is variable. It is known that when such pumps are in use the reaction forces on the radial pistons tend to urge the cam ring 12 towards a position of minimum eccentricity. Cam ring 12 is acted on by a piston 13 responsive to a servo pressure in a line 14, an increase in this servo pressure urging cam ring 12 against the piston reaction forces towards a position of increased eccentricity.

A line 15 communicates with the main outlet passage 16 of the pump, and also with a low pressure return line 17 via an adjustable flow restrictor 18 and a solenoid-operated valve 19 connected in series. It is arranged that the flow area of valve 19, in its open condition, is also adjustable, by a device 19*a*.

A control valve 20 has a body 21 within which is a stepped bore 22. A spool control element 23 has lands 24, 25 slidable in respective portions of the bore 22. A first inlet 26 opens into the bore 22 between the lands 24, 25 and communicates with the interconnection between the restrictor 18 and valve 19. The pressure intermediate restrictor 18 and valve 19 provides an operating pressure which urges the control element 23 leftwards, as seen in the drawing, against the bias applied by a spring 27.

The element 23 has an axial through passage 28 which communicates via an outlet 29 with the low pressure return line 17. A second outlet 30 from the bore 22 communicates with the servo pressure line 14 and co-operates with the land 24, so that the servo pressure in line 14 is derived from that at the inlet 26 and outlet 29, dependent on the axial position of control element 23. A second inlet 31 opens into the bore 22 and communicates with the line 15 via an adjustable flow restrictor 32.

In use, with valve 19 shut the operating pressure in inlet 26 is that in the pump outlet passage 16. An increase in pump delivery pressure, due for example to a decrease in the flow through an external load, causes an increase in the piston reaction forces on the cam ring 12. This increase in pressure also urges control element 23 leftward, decreasing the servo pressure at outlet 30. The resultant decrease in cam ring eccentricity reduces the pump delivery pressure to a valve at, or near, its original level. The arrangement is similarly responsive to a fall in pump delivery pressure to urge the cam ring 12 towards its position of maximum eccentricity.

In a low flow demand condition the pressure at the pump outlet 16 can be reduced by operation of the valve 19, either automatically or manually. The valve 19 then acts as a flow restrictor in series with the restrictor 18. The operating pressure at inlet 26 then becomes some value between the pressures in lines 15 and 17, this value depending on the effective orifice areas of restrictor 18 and valve 19. This reduction of the operating pressure at inlet 26 causes control element 23 to move to the right. Though this rightward movement would, in normal operation, increase the servo pressure in line 14, the servo pressure is, in fact, limited by the reduction in operating pressure to a value which permits the piston reaction to move the cam ring in a direction to reduce pump stroke. The consequent reduction in pump delivery pressure reinforces this effect which, except for the operation of restrictor 32 and inlet 31, would continue until the pump 10 reached zero displacement.

At a predetermined point in the rightward travel of control member 23, the land 25 uncovers inlet 31, and the pump outlet 16 is connected to the return line 17 via restrictor 32 inlet 31 and outlet 29. The consequent reduction in pump outlet pressure reduces the aforesaid reaction forces which urge the cam ring towards its position of minimum eccentricity. This reduction of the reaction forces causes movement of the cam ring 12 to be arrested before the pump is fully de-stroked. Liquid is thus displaced through the pump at a rate dependent on the setting of the restrictor 32, and with a pressure dependent on the settings of restrictor 18 and valve 19.

Valve 19 is operated in conjunction with hydraulic equipment, not shown, which receives its actuating pressure from the pump 10. Valve 19 is opened when this hydraulic equipment is rendered inactive and there is consequently no flow demand on the pump 10. The flow through restrictor 32 is adjusted so that, in this operating condition, flow through the pump is sufficient to maintain adequate cooling without requiring an undue power input to the pump 10.

I claim:

1. A control valve arrangement for a variable-stroke positive displacement pump which includes a stroke-varying device operated by a servo pressure, said control valve arrangement comprising a body having a bore, a spool control element slidable in said bore, first and second inlets communicating with said bore, means for applying to said first inlet an operating pressure derived from the outlet pressure of said pump, means for connecting said second inlet to the outlet of said pump, said operating pressure urging said control element in a first direction, means biasing said control element in a second direction against said operating pressure, a first outlet for connecting said bore to a low pressure, a second outlet communicating with said bore, said control element being operable to derive said servo pressure at said second outlet from the pressures at said first inlet and said first outlet, movement of said control element in said first direction acting to vary the servo pressure at said second outlet in a sense to reduce the stroke of said pump, and means for reducing the pressure at said first inlet, said spool control element including means responsive to movement of said control element by more than a predetermined amount in said second direction for interconnecting said second inlet and said first outlet.

2. An arrangement as claimed in claim 1 in which said means for reducing the pressure at the first inlet comprises a first restrictor and a valve means arranged in series for connection between the pump outlet and a low pressure, the interconnection between said first restrictor and said valve means communicating with said first inlet.

3. An arrangement as claimed in claim 1 in which said bore is stepped and said control element includes lands slidable in respective portions of said bore, said first inlet opening into said bore intermediate said lands.

4. An arrangement as claimed in claim 1 in which said control element includes an axial through bore by means of which said first outlet can communicate with said second outlet.

5. An arrangement as claimed in claim 1 in which said valve means for connecting said first restrictor to a low pressure comprises an electro-magnetic actuator and means for varying the flow area of said valve means, in the open condition thereof.

* * * * *